United States Patent [19]

Harvey

[11] Patent Number: 4,471,263

[45] Date of Patent: Sep. 11, 1984

[54] BUTTABLE DISPLAY PANELS

[75] Inventor: Edgar L. Harvey, Jamesburg, N.J.

[73] Assignee: Burroughs Corporation, Detroit, Mich.

[21] Appl. No.: 355,678

[22] Filed: Mar. 8, 1982

[51] Int. Cl.[3] ..... H01J 17/49

[52] U.S. Cl. ..... 313/583; 313/584

[58] Field of Search ..... 313/585, 584, 583, 51, 313/517, 514; 174/52 FP; 361/421, 426, 416, 406

[56] References Cited

U.S. PATENT DOCUMENTS

| | | | |
|---|---|---|---|
| Re. 29,858 | 12/1978 | Miller | 313/585 |
| 2,898,522 | 8/1959 | Handen | 361/416 X |
| 3,631,530 | 12/1971 | Ogle | 313/584 |
| 3,747,209 | 7/1973 | Chow | 174/52 FP X |
| 3,828,218 | 8/1974 | Fehnel | 313/514 X |
| 3,832,498 | 8/1974 | Lawson | 339/198 R X |
| 3,949,261 | 4/1976 | Harvey | 313/585 |
| 3,989,981 | 11/1976 | Ogle et al. | 313/584 X |
| 3,996,490 | 12/1976 | Miller | 313/585 |
| 4,224,637 | 9/1980 | Hargis | 174/52 FP X |

*Primary Examiner*—Palmer Demeo

*Attorney, Agent, or Firm*—Kevin R. Peterson; Edmund M. Chung; Robert A. Green

[57] ABSTRACT

A display panel comprises a gas-filled envelope made up of a base plate and a face plate sealed together hermetically. The base plate is provided with a plurality of parallel, longitudinal slots in its top surface, and vertical slots in its end edges, and an anode wire is disposed in each of the longitudinal slots in the base plate, and they are recessed in the edge slots and terminate at pins secured to the bottom surface of the base plate. Cathode electrodes are provided on the base plate, and they also terminate at pins secured to the bottom surface of the base plate. With this arrangement, panels can be butted end to end to provide a longer line of characters than one panel alone.

1 Claim, 4 Drawing Figures

BUTTABLE DISPLAY PANELS

BACKGROUND OF THE INVENTION

Gas-filled display panels known as SELF-SCAN panels are dot matrix display devices which, for various reasons relating to panel construction and operation, can display, at most, 20 to 40 characters in a row. There are data processing operations where it would be desirable to be able to display 80 characters or more in a row, and this can be achieved by butting together two small panels of proper construction. At least one type of buttable panel has been suggested in U.S. Pat. No. 3,996,490, dated Dec. 7, 1976, of Donald E. Miller; however, this panel has never become commercially successful.

The present invention provides a commercially feasible display panel which is buttable so that a row of almost any desired number of characters can be provided.

DESCRIPTION OF THE INVENTION

Figure 1:
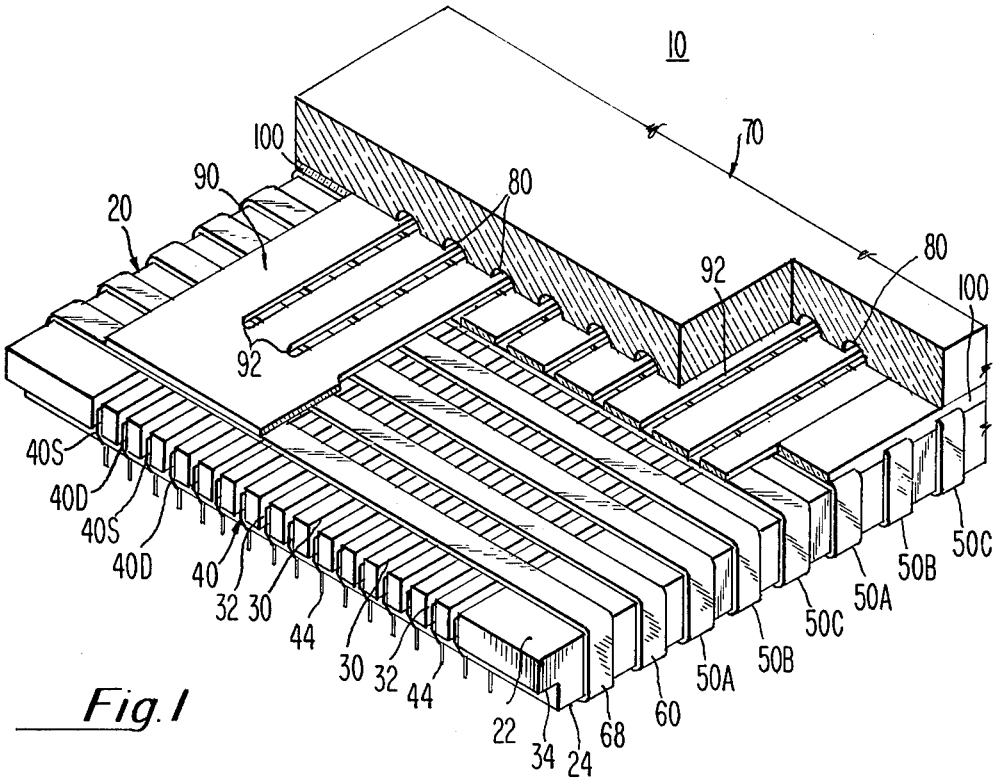
FIG. 1 is a perspective exploded view, partly in section, of a buttable display panel embodying the invention.

The present invention relates to SELF-SCAN panels of the type described in U.S. Pat. No. 3,989,981 of James A. Ogle and George E. Holz, dated Nov. 2, 1976; in U.S. Pat. No. Re. 29,858, dated Dec. 5, 1978, of Donald E. Miller; and in a copending application of Edgar L. Harvey entitled Display Panel, Ser. No. 335,753, filed Dec. 30, 1981; all of which are incorporated herein by reference. The construction of the panel of the invention is most like panels in the latter application.

A Self-Scan display panel 10 embodying the invention includes a glass base plate 20 having a plurality of parallel longitudinal slots 30 which extend across and into the top surface 22 thereof. The slots 30 terminate in vertical edge slots 32 formed in the left and right end edges of the base plate. The lower surface 24 of the base plate is also notched at each end as represented by reference numeral 34. Anode electrodes 40S and 40D, which may be in the form of wires, are seated in the slots 30, with the anodes 40S and 40D alternating with each other. Anodes 40S are scan anodes, and anodes 40D are display anodes.

Figure 2:
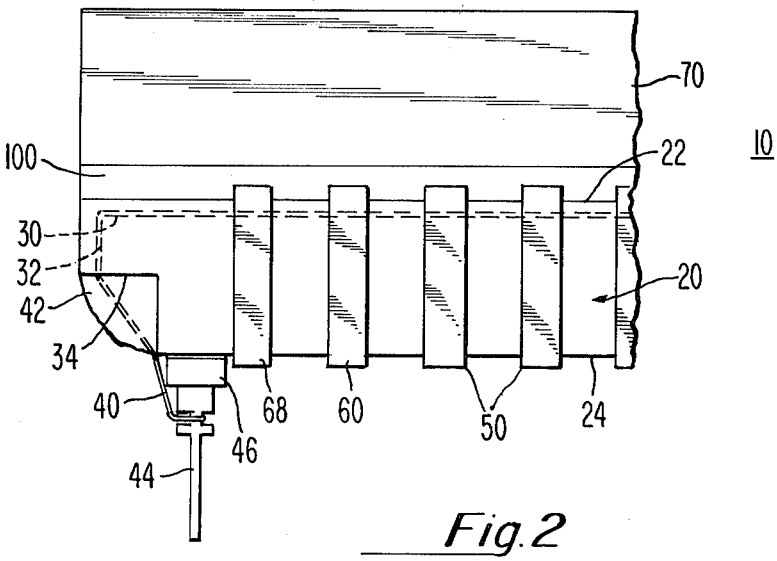
FIG. 2 is a side view of a portion of the panel of FIG. 1.
Figure 3:
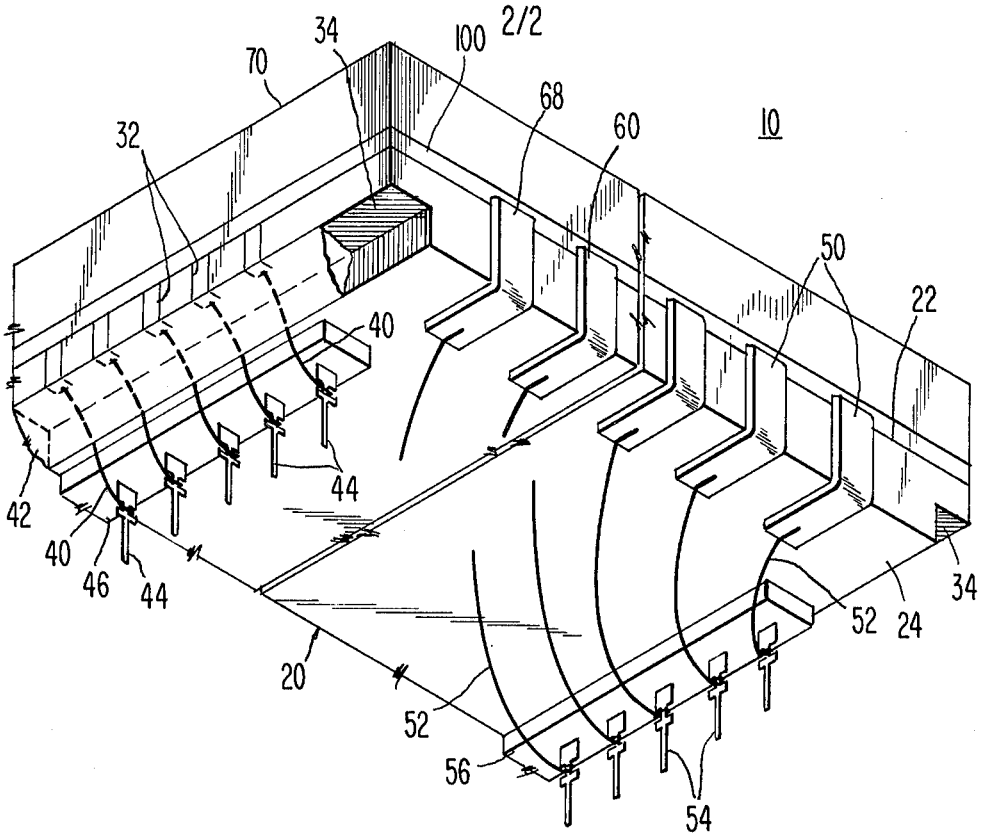
FIG. 3 is a perspective view of the bottom of the panel portion shown in FIG. 2.

The anodes 40 extend along the slots 30, down the edge slots 32, into the notches 34 in which they are cemented by glass frit 42. The ends of the wires are wound on and secured, each to one vertical pin 44 (FIGS. 2 and 3) mounted on an insulating block 46 which itself is secured to the lower surface 24 of the base plate 20.

Cathode electrodes 50, in the form of narrow, metal strips, are provided on the top surface of the base plate 20, and they are preferably set in place by winding one or more wires and then cutting to provide the individual wires or groups of wires. The wound wire is preferably cut adjacent to the bottom surface of the base plate (FIG. 3), and the individual cathodes or groups of cathodes are connected by suitable leads 52 to pins 54 held in place by an insulating block 56 secured to the bottom surface of the base plate. The blocks 46 and 56 may be secured to the base plate at opposite ends of the panel. The location at which each cathode 50 crosses an anode 40 defines a column of cells; where each scan anode 40S is crossed by a cathode pair is a scan cell, and where each display anode 40D is crossed by a cathode is a display cell. In each column, the scan cells alternate with the display cells, and in the rows of cells, the scan cells are aligned, and the display cells are aligned.

A SELF-SCAN panel also includes a reset cathode electrode 60 adjacent to the first cathode 50A in the array of cathodes 50. The reset cathode forms a column of reset cells with the anode 40.

A suitable keep-alive arrangement is also provided in the panel.

The panel 10 includes a glass face plate 70 having an inner surface which is chemically etched to provide a plurality of parallel shallow slots or depressions 80 having a depth of about 3 to 4 mils. The slots 80 are disposed transverse to the cathodes 50 and overlie each row of display cells. This inner surface of the face plate 70 is coated with a thin layer 90 of black insulating material to provide light contrast. This layer is about one mil thick, and it covers the entire inner surface of the face plate, but not the slots or depressions 80. In this area, the layer 90 has display slots 92 which are aligned with the slots 80 in the face plate. These slots 92 in coating 90 are also aligned with the rows of display cells. The rest of the layer 90 overlies the scan cells and blocks them from being seen through the face plate 70. The face plate is hermetically sealed to the base plate and seated on the cathodes 50, 60 and electrode 68 by means of a thin glass frit sealing ring 100 which is screened on the edge of the face plate at a thickness of about one mil. The anode slots 30 are filled with the sealing material along the edges of the panel so that the panel is completely hermetically sealed.

Figure 4:
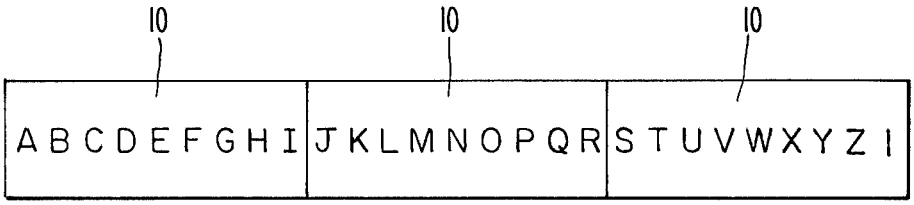
FIG. 4 is a plan view of a plurality of display panels embodying the invention butted together to display a line characters.

Since the panel 10 is intended to be butted end to end with other similar panels, as illustrated in FIG. 4, the seal at the ends of the panel should be as narrow as possible. With such an arrangement, the spacing between displayed characters at the junction of two panels will be substantially the same as within a panel.

The panel is filled in any suitable manner with an ionizable gas such as neon or argon and a small quantity of xenon.

The above-identified patent application described the operation of panel 10 wherein positive operating potential is applied to all of the scan anodes 40S, and relatively more negative potential is applied to reset cathode 60. These potentials, aided by keep-alive particles, cause the turn-on of the column of reset cells formed by the crossing of reset cathode 60 and the scan anodes 40S. This represents the beginning of a scanning cycle.

The scanning cycle then is carried out by the application of operating potential to each of the cathodes 50 in turn, beginning with the cathodes adjacent to the reset cathode 60. This turns on all of the scan cells in each column of cells sequentially. With all scan cells in a column turned on, there is cathode scan glow present at the lower surface of the overlying cathode 50 above all of the scan anodes 40S. This scan glow is not visible to a viewer either because it is at the lower surface of each cathode; or, if it moves to the upper surface, it is not visible because of black coating 90. As the columns of scan cells are then turned on sequentially, information signals of sufficient magnitude are applied to selected display anodes 40D, and this causes glow to transfer from a scan slot 30 to a display slot 30 across the land between them to the portion of the top surface of the cathode overlying the selected display anode(s) 40D. This glow is visible to a viewer because it is aligned with slots 92 and 80. As the scanning operation is carried out through the panel and selected display cells are caused to glow, an apparently stationary but changeable message is visible in the energized display cells.

The panel of the invention, as noted, is constructed so that two or more can be placed together end to end, as illustrated in FIG. 4. Thus, two or more panels can combine to display a line of 80 characters or more in a message. In operation of such an array of panels 10, the panels may be scanned sequentially and continually to display the desired message which appears to be stationary but is changeable in accordance with input information applied to the panels. In another mode of operation, the panels may be operated in parallel to display the desired message in each.

What is claimed is:

1. A display panel system comprising a plurality of display panels arrayed side by side with their viewing areas being aligned in series, each display panel comprising a gas-filled envelope made up of a base plate having a top surface and a bottom surface and a face plate hermetically sealed to said base plate, a plurality of anode electrode wires disposed horizontally paralled to each other in slots in the top surface of said base plate and extending along the top surface of said base plate, portions of said anode electrodes being recessed in notches in the ends of said base plate, and the ends of said anode electrodes being secured in place at the bottom surface of said base plate, and cathode electrode strips disposed vertically on said top surface of said base plate and oriented at an angle to said anode electrodes, the crossings of said anodes and cathodes defining the viewing area of the panel, said cathodes having their ends terminating adjacent to the bottom surface of said base plate and secured in place thereat, said panels being aligned so that the ends of the base plates which are notched abut each other and permit the viewing area of one panel to lie close to the viewing area of an adjacent panel so that a single message can be displayed by the combination of the displays in the two panels.

* * * * *